United States Patent [19]

Miessler

[11] 4,034,583

[45] July 12, 1977

[54] WASHING MACHINES

[75] Inventor: Heinz Miessler, Schulenburg, Leiner, Germany

[73] Assignee: Firma Vosswerk GmbH, Germany

[21] Appl. No.: 663,285

[22] Filed: Mar. 3, 1976

[51] Int. Cl.[2] ..... D06F 21/02; D06F 37/08

[52] U.S. Cl. ..... 68/16; 68/143

[58] Field of Search ..... 68/16, 58, 139, 142, 68/143, 144, 145

[56] References Cited

U.S. PATENT DOCUMENTS

| | | | |
|---|---|---|---|
| 1,586,022 | 5/1926 | Barker | 68/58 |
| 2,691,884 | 10/1954 | Walker | 68/139 |
| 3,352,131 | 11/1967 | Smith | 68/58 |
| 3,707,858 | 1/1973 | Gulzow et al. | 68/145 X |
| 3,946,580 | 3/1976 | Stoll | 68/145 |
| 3,969,913 | 7/1976 | Schaper | 68/143 |

*Primary Examiner*—Philip R. Coe

*Attorney, Agent, or Firm*—Mason, Mason & Albright

[57] ABSTRACT

A washing machine comprises a rotatable washing drum divided by an internal screw conveyor into a number of separate washing and rinsing zones. A chamber mounted on the external surface of the drum in the area of the principal washing zone communicates with the principal washing zone and contains a partition which defines a liquid-containing pocket. This pocket is at least partially filled with liquid throughout rotation of the drum and contains a heating device which acts to heat the liquid.

1 Claim, 14 Drawing Figures

WASHING MACHINES

BACKGROUND OF THE INVENTION

1. FIELD OF THE INVENTION

The present invention relates to washing machines.

2. DESCRIPTION OF THE PRIOR ART.

There have been proposed washing machines comprising an unperforated washing drum, rotatable in either direction of rotation, and a conveyor screw which is firmly connected to the drum and subdivides the latter into individual treatment zones with at least one principal washing zone. The chambers are distributed along the periphery of the washing drum in the area of the principal washing zone and in communication with the internal space of the washing drum. A heating device, for example a heating coil, is situated in each of these chambers, and heats the liquid present in these chambers, the liquid heated in this manner being mixed with the liquid present in the lower portion of the washing drum during the rotary displacement of the washing drum in the one direction or the other, and thus resulting in an increase in the temperature of the liquid available for the washing operation and thereby in an intensification of the washing operation.

The incorporation of several chambers arranged along the periphery of the washing drum in the area of the principal washing zone is necessary, because at least one chamber — namely the chamber situated at the lowest position at the instantaneous position of the washing drum — must be filled by the liquid in each position of the washing drum, this liquid then being heated by the heating device and mixed with the liquid present in the washing drum. The other chambers are free of liquid in this case, so that the heating devices associated with those other chambers must be rendered inoperative.

The great structural complexity consequent upon the incorporation of several chambers with corresponding heating devices and piping systems, is disadvantageous. This structural complexity leads not only to high production costs and in bulky appearance, but also renders such a washing machine liable to breakdowns.

It is an object of the invention to overcome the above disadvantages.

SUMMARY OF THE INVENTION

According to the invention, there is provided in a washing machine a washing drum rotatable in either direction of rotation, screw conveyor means rotatable with the drum and dividing the interior of the drum into a plurality of separate treatment zones at least one of which constitutes the principal washing zone of the machine, means defining a chamber mounted on the washing drum in the area of the principal washing zone, means providing communication between the other chamber and the interior of the drum, and partition means defining a liquid-containing pocket within the chamber, said pocket being at least partially filled with liquid at every angular position of the drum.

BRIEF DESCRIPTION OF THE DRAWINGS

An embodiment of the invention will now be described, by way of example only, with reference to the accompanying diagrammatic drawings, in which.

DESCRIPTION OF THE PREFERRED EMBODIMENT

Figure 1:
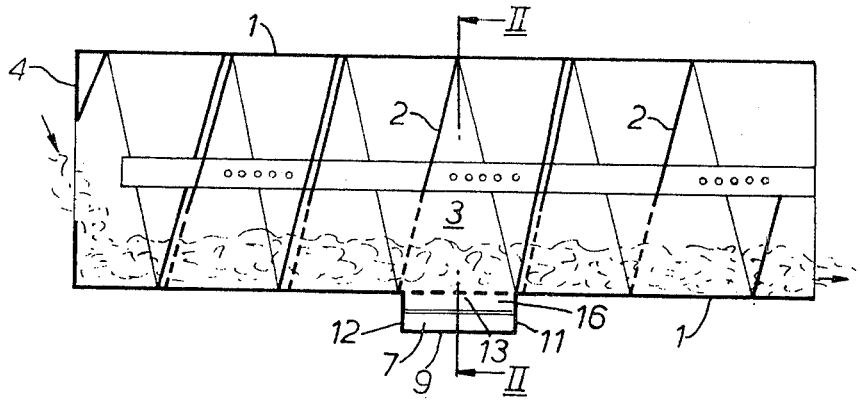
FIG. 1 is a longitudinal cross-section of a washing machine in accordance with the invention.

As shown in FIG. 1, the washing machine comprises an elongate cylindrical washing drum 1 rotatable about a horizontal axis and which encloses a conveyor screw 2 connected to the washing drum 1 in an appropriate manner, for example by welding. The conveyor screw 2 subdivides the washing drum 1 into separate treatment zones, for example washing and rinsing zones, the principal washing zones being designated 3. In the embodiment illustrated, one end of the washing drum 1 is partially closed by an annular cover 4. Entraining ribs 5 are arranged on the internal surface of the washing drum 1.

As apparent from the drawings, a single chamber 7 in communication with the interior 6 of the drum 1 is arranged on the external surface of the washing drum 1 in the area of the principal washing zone 3. The chamber 7 is defined by side walls 8 and 10, and a bottom wall 9, the wall 10 extending approximately tangentially into the drum casing 1; the chamber also has end walls 11 and 12 which prevent an outflow of the mixture in the longitudinal direction of the washing drum 1. The drum has a perforate area 13 provided by bores in the surface of the drum to provide communication between the chamber 7 and the interior 6 of the drum 1. With the exception of this perforated area the entire outer surface of drum is solid. There is located in the chamber 7 a partition assembly 14, 15 which defines with the adjacent surface portion of the drum 1, a liquid pocket 16. The partition assembly 14, 15 is so arranged that the liquid pocket 16 is at least partially filled with liquid (for example water) in every angular position of the washing drum 1.

Figure 2:
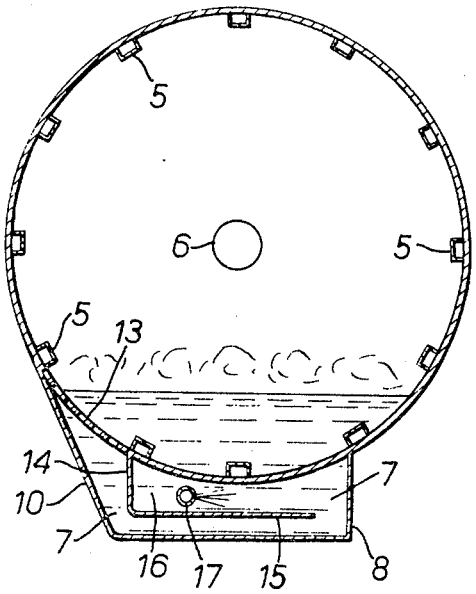
FIG. 2 is a transverse cross-section, to an enlarged scale, taken on line II—II in FIG. 1.

In the embodiment illustrated, the partition assembly 14, 15 comprises an angular plate of which one limb 14 extends outwards from the drum 1, whereas the other limb 15 is inclined to the limb 14. As shown in FIG. 2 the limbs 14, 15 are inclined relative to each other by a right angle; alternatively the limbs may be relatively inclined by an obtuse angle or an acute angle. The limb 14 is situated adjacent the end of the perforate area 13.

Figure 3:
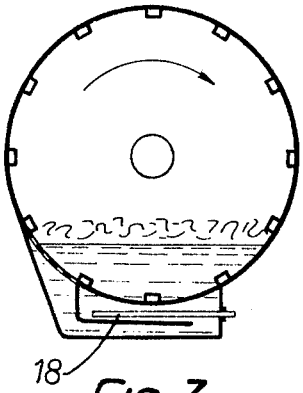
FIG. 3 is a section, similar to FIG. 2, of a modified form of the machine.

A heating device for heating the liquid is situated in the liquid pocket 16. Any appropriate heating may be used for this purpose. As shown in FIG. 2, the heating device is in the form of a steam pipe 17 from which steam is injected into the liquid; as shown in FIG. 3, the heating device is in the form of a coiled pipe 18 through which steam or heating water is circulated. Alternatively, the heating device may be an electrically-operated heating device.

The washing machine described above operates as follows.

Figure 4:
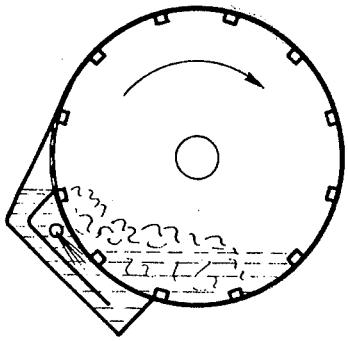
FIGS. 4 to 8 are sections similar to FIG. 2 showing the washing machine during rotary displacement of the drum in one direction of rotation.
Figure 5:
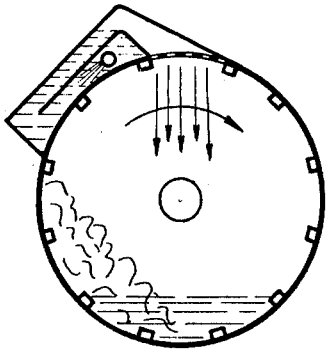
Figure 6:
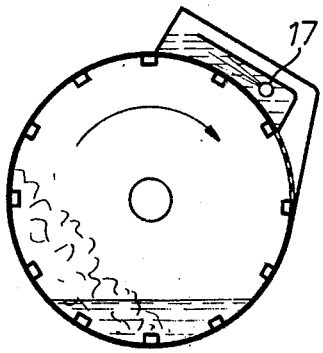
Figure 7:
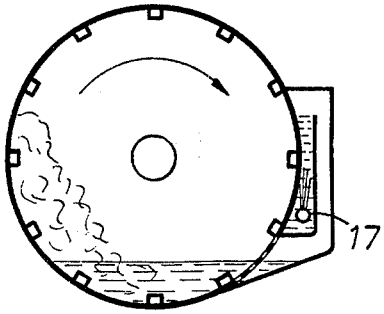
Figure 8:
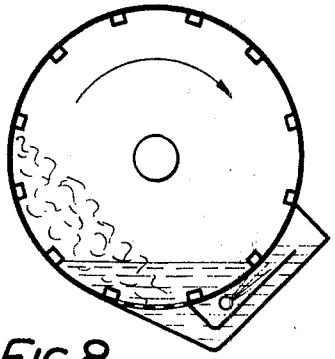
Figure 9:
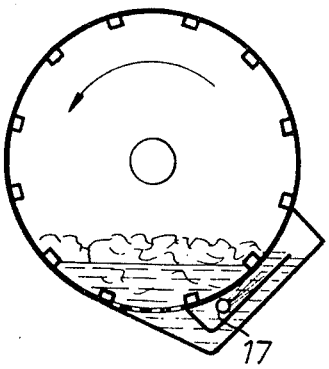
FIGS. 9 to 14 are sections similar to FIG. 2 showing the washing machine during rotary displacement of the drum in the opposite direction.
Figure 10:
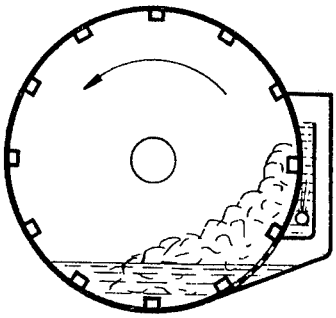
Figure 11:
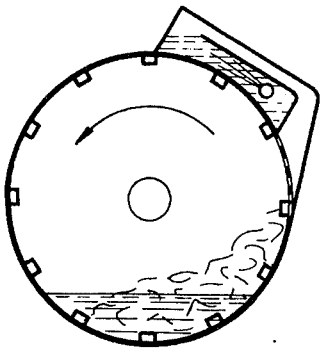
Figure 12:
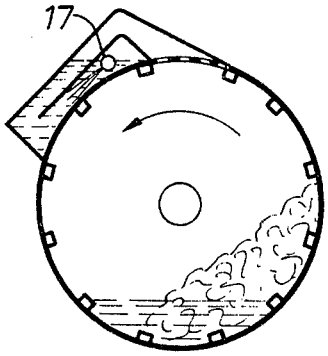
Figure 13:
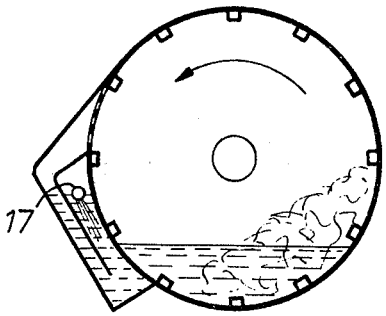
Figure 14:
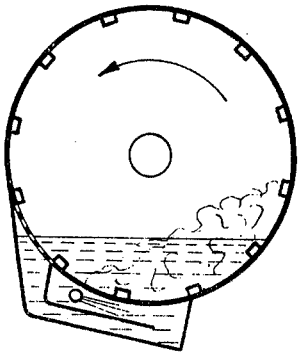

Let it be assured initially that the washing drum 1 is situated in the position illustrated in FIG. 4. In this position, the liquid pocket 16 is partially filled with liquid which is heated via the steam pipe 17. A part of the liquid heated in this manner may flow into the interior 6 of the drum 1 via the perforate area 13, prior to reaching this position.

During the rotary displacement of the washing drum 1 in the direction of the arrow, i.e. in clockwise direction, the liquid pocket 16 reaches the positions illustrated in FIGS. 4 to 8. It is essential in this connection that the liquid pocket 16 be at least partially filled with mixture in all these positions and also in the intermediate position, this liquid being heated via the steam pipe 17. During this rotary displacement of the washing drum 1, a part of the liquid heated in this manner may, at specific positions, pass via the perforate area 13 into the interior 6 of the drum 1 whereby this part of the liquid mixes with the liquid present in the lower part of the washing drum 1 and thereby leads to an increase in temperature. The washing operation is intensified to an extraordinary degree and thereby rendered efficient, by this constant input of heat.

FIGS. 8 to 14 show the same conditions during a reversal of the direction of rotation of the washing drum 1, which revolves in anticlockwise direction in accordance with the arrows depicted. In this case too, it is ensured that the liquid pocket 16 is at least partially filled with liquid at every position of the washing drum 1, this liquid thereupon being admixed with the liquid present in the interior 6 of the washing drum 1 after being heated by means of the steam pipe 17.

It is clear that the minimum quantity of the liquid which should be present in any event in the liquid pocket 16, irrespective of the instantaneous position of the washing drum 1, is determined by appropriate construction and dimensioning of the water pocket 16.

In the machine particularly described the liquid pocket will be at least partially filled with liquid in every position of the washing drum, the liquid mixture being heated by the heating device present in this water pocket and then being mixed with the liquid present in the washing drum when the water pocket has reached the area of the lowest point during the rotary displacement of the washing drum. The washing operation is rendered extremely intensive by such mixing, and the degree of cleanness of the laundry is thereby optimised.

What is claimed is:

1. In a washing machine, a washing drum rotatable in either direction of rotation, screw conveyor means rotatable with the drum and dividing the interior of the drum into a plurality of separate treatment zones, at least one of said zones forming a principal washing zone of the machine, means defining a chamber mounted on the washing drum in the region of the principal washing zone, said chamber enclosing a surface portion of the drum, the surface portion of the drum enclosed by the chamber consisting of a perforated of a surface portion and a solid surface portion which joins the perforated surface portion at a boundary, partition means forming a liquid-containing pocket within the chamber, said partition means comprising an angle plate having two limbs, one of said limbs being secured to the drum in the region of said boundary and extending outwardly from the drum, and the other limb extending transversely from the said one limb and facing the solid surface portion whereby said pocket is at least partly filled with liquid at every angular position of the drum, and liquid heating means located in the pocket.

* * * * *